United States Patent [19]

Jenne

[11] 4,284,147

[45] Aug. 18, 1981

[54] CONTROL DEVICE FOR THE FORWARD MOVEMENT AND REARWARD MOVEMENT OF PNEUMATIC RAM BORING DEVICES

[76] Inventor: Gustav Jenne, Schmachtenbergstrasse 93, 4300 Essen-Kettwig, Fed. Rep. of Germany

[21] Appl. No.: 970,142

[22] Filed: Dec. 18, 1978

[30] Foreign Application Priority Data

Dec. 19, 1977 [DE] Fed. Rep. of Germany ..... 2756567

[51] Int. Cl.[3] ..... F01L 21/02; F01B 7/18

[52] U.S. Cl. ..... 173/91; 91/234; 91/277; 91/321; 92/165 PR; 175/19

[58] Field of Search ..... 92/165 PR, 108; 91/234, 91/327, 401, 222, 422, 39, 224, 352, 470, 417 R, 277; 173/91; 175/19

[56] References Cited

U.S. PATENT DOCUMENTS

| | | | |
|---|---|---|---|
| 1,050,951 | 1/1913 | Kessel | 91/23 X |
| 3,026,854 | 3/1962 | Wiedmann et al. | 91/417 R |
| 3,896,703 | 7/1975 | Bertanza | 91/401 |
| 4,100,980 | 7/1978 | Jenne | 91/234 |
| 4,144,941 | 3/1979 | Ritter | 175/19 |

*Primary Examiner*—Paul E. Maslousky
*Attorney, Agent, or Firm*—Martin A. Farber

[57] ABSTRACT

Control device for the forward movement and rearward movement of self-driven pneumatic ram boring devices with an impact piston which is axially displaceable between two abutments in a tubular housing, with the axial forward movement and rearward movement of the ram boring device being controllable by rigid control edges of an adjustable control sleeve, the latter being supported on a bearing ring arranged in the rear part of the housing. Through the bearing ring there is led a part of the control sleeve forming a feed tube for the compressed air for connection to a compressed air hose, the sleeve having a piston-like control head containing the control edges; the control head engaging in a cylindrical recess at the rear end of the impact piston cooperates with radial control bores which are formed in the area of the recess in the impact piston. The control sleeve is mounted non-displaceably in the axial direction however rotatably in the bearing ring and is provided with at least four control edges. The control edges respectively are each arranged in pairs with axial spacing corresponding to the control stroke of the impact piston and are offset in the peripheral direction as well as in the longitudinal direction, such that respectively only one pair of the control edges cooperates with the control bores. The bores are arranged only on a part of the periphery of the impact piston and the impact piston is non-rotatably guided in the housing.

8 Claims, 9 Drawing Figures

1
1a
1a'
2
3
4
4a
4b
4c
4d
5
5a
6
6a
6b
6c
7
II
III
IV
V

CONTROL DEVICE FOR THE FORWARD MOVEMENT AND REARWARD MOVEMENT OF PNEUMATIC RAM BORING DEVICES

The invention relates to a control device for the forward movement and rearward movement of self-propelled pneumatic ram boring devices with an impact piston which is axially displaceable between two abutments in an altogether tubular-shaped housing, whereby the axial forward movement and rearward movement of the ram boring device is controllable by rigid control edges of an adjustable control sleeve, the latter being supported on a bearing ring arranged in the rear part of the tubular-shaped housing, through which bearing ring a part of the control sleeve (which part is formed as a feed tube for the compressed air) is guided-through for the connection to a compressed air hose, and which sleeve has a piston-shaped control head containing the control edges, the control head engaging in a cylindrical recess at the rear end of the impact piston cooperates with radial control bores, which are formed in the area of the recess in the impact piston.

A control device of the previously described type is known for example from the German Auslegeschrift AS No. 2 537 176. The reversing of the ram bore device between forward movement and rearward movement takes place by an axial displacement of the control sleeve with respect to the housing. For this purpose a part of the control sleeve is formed as a polyhedron section, the length of which corresponds to the axial displacement movement of the control sleeve between its end positions. In the bearing ring of the housing, which bearing ring supports the control sleeve, there is formed an axial opening which corresponds to the polyhedron section of the control sleeve. At both sides of the polyhedron section there join cylindrical sections of the control sleeve, the front section of which has a diameter including the polyhedron cross-section and its rear section has a circular cross-section, the diameter of the latter being included by the polyhedron diameter.

In order to achieve the forward movement of the ram bore device, the control sleeve is brought into a forward end position; in this forward end position the corners of the polyhedron section of the control sleeve engage on the front face surface of the bearing ring (the corners projecting or rising over the diameter of the smaller rear cylindrical section), for which a rotation of the control sleeve disposed in the forward end position with respect to the bearing ring and to the housing, respectively, is required, and indeed by half the amount of the angle which is formed by the corners of the polyhedron section. The control sleeve must be turned by this angle if the ram bore device is to be reversed from the forward movement to the rearward movement. After such a rotation which brings about a coincidence between the polyhedron section of the control sleeve and the corresponding axial opening of the bearing ring, the control sleeve can be shifted in the axial direction toward the rear until the forward cylindrical section with its parts (which project or rise over the polygonal section) in the shape of circular sections engages on the forward face surface of the bearing ring. The axial displacement of the control sleeve corresponds in this case to the displacement stroke for the rigid control edges which are formed on the piston-like control head of the control sleeve by the front face surface of the control sleeve and a circular-shaped control edge, respectively, which results in an axial spacing relative to the front face surface by a reducing of the diameter of the control sleeve.

With the known control device in addition to a rotation of the control sleeve with respect to the housing and to the bearing ring, respectively, by a certain angle each time an axial displacement is necessary, if the bore device is to be reversed between forward movement and rearward movement. This reversing which even then must be able to be carried out if the ram bore device is located in the ground, takes place by a rotation and displacement of the compressed air hose which is fastened with its front end on the rear end of the control sleeve. Particularly the axial displacing of the control sleeve with respect to the housing in this case gives difficulties. As a further disadvantage of the known control device it is to be considered that the engagement of the control sleeve on the bearing ring (which supports it) in the housing only takes place over comparatively small surfaces which consequently are subjected to a very high loading and frequently cause disturbances of function or damage.

Starting from a reversing of the introductory-described type, the invention is based on the task of creating the control device for the forward movement and rearward movement of self-propelled pneumatic ram bore devices, which on the one hand can be operated simply and on the other hand functions without problems, whereby particularly high local loadings of the control sleeve should be avoided and the reversing operation should be possible even during the working of the ram bore device, i.e. under compressed air.

The solution of this task, by the invention is characterized in the manner that the control sleeve is mounted non-displaceably in the axial direction however rotatably in the bearing ring and is provided with at least four control edges which control edges respectively each are arranged in pairs with identical axial spacing, the latter corresponding to the control stroke of the impact piston, and are offset in the peripheral direction as well as in the longitudinal direction such that only respectively from time to time each one pair of the control edges cooperate with the control bores, the latter being arranged only on a part of the periphery of the impact piston, which impact piston is guided non-rotatable in the housing.

As a result of the formation of the control sleeve in accordance with the invention with control edges which are arranged in pairs, the control edges cooperating as well exclusively alternately with the control bores, which control bores are arranged in the non-rotatably guided impact piston, with the control device in accordance with the invention a rotation of the control sleeve with respect to the housing suffices in order to provide a reversing of the ram bore device between forward movement and rearward movement. The control sleeve can consequently be reliably supported on the bearing ring of the housing by means of sufficiently sized or dimensioned engagement surfaces, so that local peak loadings and consequently the danger of damage and functional disturbances are prevented. Simultaneously the operation of the ram bore device is quite considerably simplified with the reversing, since the axial displacement of the control sleeve with respect to the housing of the ram bore device is eliminated. With the known control device this axial displacement leads to considerable difficulties since the flexible compressed air hose is barely suited to transmit the necessary pressure forces for the axial displacement of the control sleeve with respect to the housing of the ram bore device.

With the formation in accordance with the invention with at least four pair-wise arranged control edges, respectively from time to time only half of the control edges cooperate with the radial control bores of the impact piston, since these control bores only are arranged on one part of the periphery of the impact piston, the latter being guided non-rotatably in the housing, so that only the control edges which are determined for the respective movement direction from time to time are overlapped or run over by the control bores of the impact piston; the respective other half of the control edges which are formed rigidly on the control sleeve remain inoperative since they then lie respectively outside of the range of the control bores. The selection of the control edges which are operative with the control bores from time to time is brought about in a simple manner by rotation of the control sleeve with respect to the housing and consequently with respect to the impact piston, the latter which is guided non-rotatably in the housing.

With the simplest form of the formation in accordance with the invention the four control edges each respectively are formed extending over 180° of the periphery of the control sleeve. With a preferred additional development of the invention eight control edges each extend over 90° of the periphery of the control sleeve, whereby identical control edges are formed diametrically oppositely on the control sleeve. In this manner a symmetrical flow takes place inside of the ram bore device. Of course it is possible to form another multiple, namely 12 or 16 control edges on the control sleeve. This is particularly possible with ram bore devices with large diameter.

According to a further feature of the invention the front pair of control edges can be formed on the one hand by the front face edge of the control sleeve by the front face edge of the control sleeve, and on the other hand by an edge of a recess, the latter starting from the rear end of the piston-like control head, and the rear pair of control edges can be formed by the arc or curve (which extends in the peripheral direction) of a recess (which recess starts from the front face edge) and by the rear face edge of the control head, respectively. Of course even other specialized formations of the control edge pairs are possible.

In an additional development of the main concept of the invention the impact piston can be secured against rotation by means of a longitudinal groove and a ridge which is formed on the cylindrical inner wall of the housing. Alternatively to this it is possible to provide the impact piston with a longitudinal groove in which there engage at least two projections which are disposed spaced apart from one another, which projections are arranged on the inner wall of the housing. A particularly simple formation for the non-rotatable guiding of the impact piston in the housing takes place in accordance with a further feature of the invention when the projections are formed by screws which are screwed into the housing.

With the invention finally it is proposed to secure the control sleeve which is rotatable between two end positions in the bearing ring in each end position by a non-positive—and/or positive—rotational-securing against unintentional rotation.

In the drawing one preferred embodiment example of the control device in accordance with the invention is illustrated, and indeed it shows:

Figures 1, 2, 3, 4, 5, 5A:
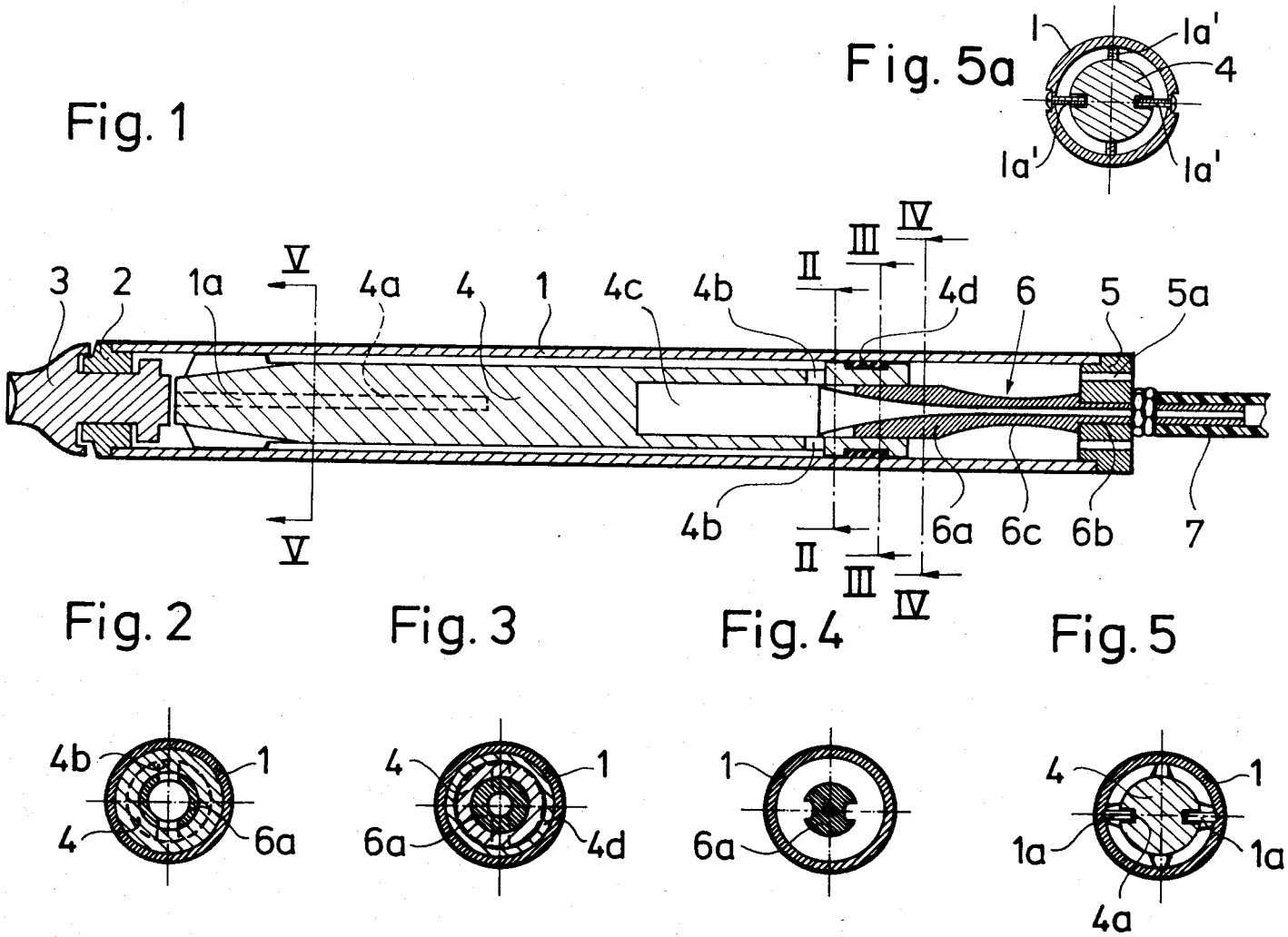
FIG. 1 is a longitudinal section through a complete ram bore device.
FIG. 2 is a cross-section according to the section line II—II in FIG. 1.
FIG. 3 is a cross-section according to the section line III—III in FIG. 1.
FIG. 4 is a cross-section according to the section line IV—IV in FIG. 1.
FIG. 5 is a cross-section according to the section line V—V in FIG. 1.
Figure 6:
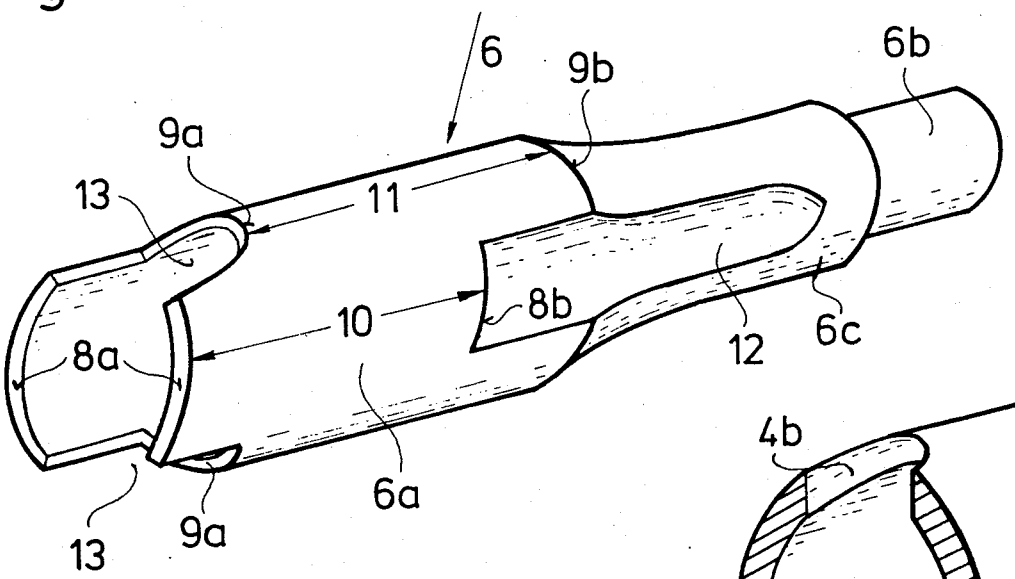
Figure 7:
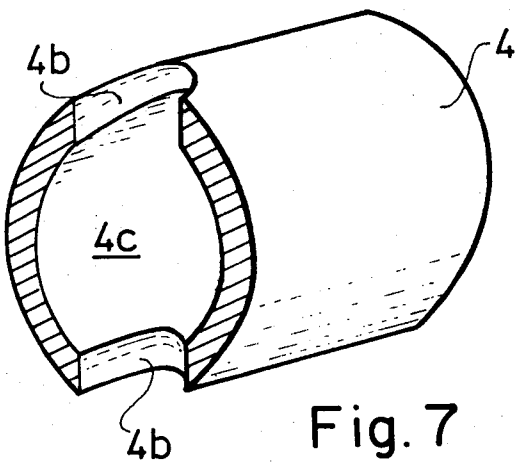
Figure 6A:
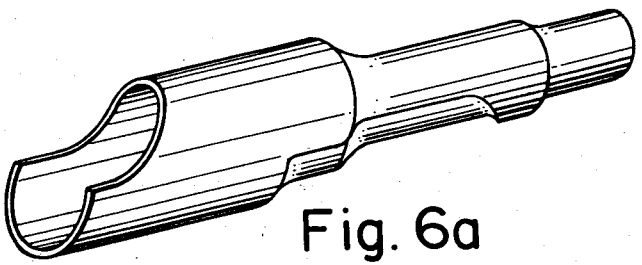

FIG. 5*a* is a view similar to FIG. 5 but showing screws as one modification,

FIG. 6 is an isometric illustration of a control sleeve in enlarged scale,

FIG. 6*a* is a view similar to FIG. 6 but showing a control sleeve with only four control edges, and FIG. 7 is an illustration corresponding to FIG. 6 of the impact piston cut in the vicinity of the control bores.

The ram boring device illustrated as the embodiment example has a tubular-shaped housing 1, on the front end of which there is fastened a guide ring 2. In a central bore of the guide ring 2, as impact tip or point 3 is displaceable in the axial direction about a path which corresponds approximately to the bore advance of the ram boring device each impact impulse. An impact piston 4 cooperates with this impact point 3, the piston being axially moveable in the housing 1, however non-rotatably guided. For this purpose with the illustrated embodiment the impact piston 4 is provided with a longitudinal groove 4*a*, which groove is guided on a ridge 1*a*, the latter being formed on the cylindrical inner wall of the housing 1.

Instead of this ridge 1*a*, at least two projections which lie spaced from one another can be formed on the cylindrical inner wall of the housing 1, which projections engage in the longitudinal groove 4*a* of the impact piston 4 as a rotation-preventive. As such type of projections screws 1*a*' (FIG. 5*a*) can be used which are preferably screwed in the housing 1, the screws engaging with their front end in the longitudinal groove 4*a*. Of course the heads of these screws 1*a*' can be arranged sunk into the housing 1.

The non-rotatably guided impact piston 4 is moved back and forth in the housing 1 by means of compressed air, whereby it exerts its impact action selectively on the impact tip 3 or on a bearing ring 5 which is secured on the rear end of the tubular-shaped housing 1. If the impact piston 4 exerts its impact action on the impact tip 3, the ram boring device moves in the advance or positive drive direction. If to the contrary the impact direction of the impact piston 4 is reversed, so that the force which is produced by the impact piston 4 is exerted on the bearing ring 5, the ram boring device runs back.

The feed of the compressed air and the reversing between forward and rearward movement takes place by a control sleeve 6 as the embodiment example which is illustrated in enlarged scale in FIG. 6. The altogether tubularly-shaped control sleeve 6 which has a piston-like thickened control head 6*a* projects with a cylindrical part 6*b* through a centering bore in the bearing ring 5. On the end of the cylindrical part 6*b*, which end projects from the bearing ring 5 toward the rear, there is fastened a compressed air hose 7, through which there is fed the compressed air which is needed for driving the impact piston. The air which is depressurized by driving the impact piston 4 escapes from the housing 1 through bores 5a which are provided in the bearing ring 5.

In the area of the control head 6a on the control sleeve 6 there are formed at least four fixed or rigid control edges 8a, 8b and 9a, 9b, which form two different types of pairs, namely one type of pairs being 8a, 8b and the other type being 9a, 9b. Each of these pairs is arranged with axial spacing 10 and 11, respectively, from one another corresponding to the control stroke of the impact piston 4. These spacings 10 and 11 are drawn in FIG. 6. To the contrary of the known formations, in this manner the possibility is provided to form the distance 10 and 11, respectively, between the control edges 8a, 8b for the forward movement of the entire ram boring device and the control edges 9a, 9b for the rearward movement of the entire ram boring device, differently, whereby the run-on characteristic and the bounce or striking speed may be optimized much more favorably. Moreover a shorter total length of the ram bore device is possible, since for the rearward movement only a shorter distance 11 of the control edges 9a, 9b is necessary.

The control edge pair which is formed by the control edges 8a and 8b is offset in the peripheral direction with respect to the control edge pair made of the control edges 9a and 9b. With the illustrated embodiment example the axis of the control edges 8a, 8b, 9a, 9b respectively each are circumferentially offset by 90° so that all together there result eight control edges, whereby the same control edges each respectively lie diametrically oppositely on the control sleeve 6. Of course also a formation is possible with only four control edges each extending over 180° of the periphery (FIG. 6a). Particularly with ram bore devices with a larger diameter, moreover it is possible to provide a larger number of control edges, whereby the number however respectively is a multiple of four.

The embodiment of the control sleeve 6 which is illustrated in the drawing with altogether eight control edges 8a, 8b, 9a, 9b provides a flow course of the compressed air which is symmetrical to the prevailing longitudinal center plane at the time; consequently the use of only four control edges is preferred.

The front control edge 8a of the first pair of control edges is formed by the front edge of the control head 6a. The rear control edge 8b of this pair is formed by an edge, which edge is made by a recess 12, the latter starting from the rear end of the piston-like control head 6a. By means of the control edges 8a and 8b, the inpact piston 4 obtains its drive in the advance direction.

For creating the forward control edge 9a of the second pair of control edges, respectively one recess 13 is provided, which recess originates from the front face edge of the control sleeve 6. The curve of this recess 13, which curve runs in the peripheral direction, which runs spaced, however parallel to the front edge of the control head 6a over an arc of less than 90°, forms the control edge 9a of the second pair of control edges. The corresponding rear control edge 9b is formed by the rear rim of the control head 6a, which control head transfers or passes at this end by a hollowing rounding out or filleting into a middle section 6c of the control sleeve 6. The middle section with respect to the control head 6a has an altogether smaller diameter. The outer diameter of the middle section 6c is however considerably larger than the outer diameter of the rear cylindrical part 6b, so that the annular surface which is formed at the transfer transition between the middle section 6c and the cylindrical part 6b serves as a support surface for the control sleeve 6 on the bearing ring 5.

The rigid control edges 8a, 8b, 9a, 9b which are formed on the control sleeve 6 cooperate with the control bores 4b, the latter being formed as radial bores in the rear part of the impact piston 4. In this rear part this impact piston 4 has a cylindrical recess 4c. The control sleeve 6 with the control head 6a projects in the cylindrical recess 4c. These control bores 4b are disposed only on a part of the periphery of the impact piston 4 which is non-rotatably guided in the housing 1, so that they cooperate either with the pair of control edges 8a and 8b or with the pair of control edges 9a and 9b, and indeed depending upon the position of the control sleeve 6, the latter being rotatable in the bearing ring 5 between two positions. The annular area about the impact piston 4 is sealed off from communication with the bores 5a in the bearing ring 5 by means of an annular sealing member 4d, except from time to time via the control edges 8b, 9b.

For driving the ram boring device in the advance direction, the control sleeve 6 is turned in that position (not shown) in which the control edges 8a and 8b cooperate with the control bores 4b. In this case the compressed air which is supplied through the compressed air hose 7 as well as the control sleeve 6 drives the impact piston 4 with high energy against the impact point 3, so that the ram boring device moves in the advance direction. In order to reverse the direction of movement of the ram bore device, the control sleeve 6 is turned by 90° in the bearing ring 5 (by means of the compressed air hose 7) into the position illustrated in FIG. 1 of the embodiment example. As a result of the non-rotatable arrangement of the impact piston 4 in the housing 1, by this rotation of the control sleeve 6 relative to the housing 1, now the control edges 9a and 9b can cooperate with the control bores 4b in the impact piston 4. Since relative to the control edges 8a, 8b, the control edges 9a, 9b are formed rearwardly offset on the control head 6a in the longitudinal direction of the ram bore device, these control edges 9a and 9b cause the compressed air to be applied on the front face surface of the impact piston 4, such that the impact piston 4 is moved rearwardly and the impact energy of the impact piston 4 is exerted on the bearing ring 5. The entire ram bore device consequently moves rearwardly in the previously bored hole.

The flow paths during the back and forth movement of the impact piston 4 are basically the same for both of the two working cycles of forward (advancement) and rearward (retraction) movement of the overall ram boring device discussed above. However in the rearward working cycle the control edges 9a, 9b are aligned to cooperate with the control bores 4b, whereas in the forward working cycle the control edges 8a, 8b are operatively aligned with the control bores 4b, the relatively offset rearward displacement of the control edges 9a, 9b, bringing about with the latter a displacement toward the rear of the range of the control stroke, namely the range of the back and forth reciprocation of the impact piston 4 in the housing 1 causing the piston 4 to impact the rear bearing ring 5 instead of the front impact tip 3. Impact at the front tip 3 occurs only in the forward working cycle since the control edges 8a, 8b are relatively forwardly shifted. This shift of the range of the control stroke of the impact piston 4 is a result of earlier or later communication of the respective control edges with the control bores 4b also causing the build-up of air cushions to be stronger or weaker at the front of the piston 4 and at the rear in chamber 4c. The flow paths are as follows, starting for example at the beginning of the rearward position of the impact piston 4, where the compressed air flows through the center of the controlled sleeve 6 into the then sealed chamber 4c in the impact piston, thereby driving the impact piston forward. Simultaneously the annular space around the impact piston 4 communicates via the overlapping control bores 4b and the control edges 8b (or 9b depending on the working cycle) and the recesses 12 (or the middle section 6c) with the bores 5a of the bearing ring for the exhaust. During the next portion of the advance stroke of the piston 4, when the control bores 4b move forwardly beyond the control edges 8b (or 9b), this last-mentioned communication is blocked. Thereafter near the end of the advance stroke of the impact piston, the control bores 4b overlap the control edges 8a (or 9a) of the control sleeve, whereupon the compressed air flow starts entering into the outer annular space around the impact piston 4.

After impact at the front tip 3 and/or after the compressed air build-up develops at the area at the front of the impact piston 4 the compressed air drives the impact piston 4 in the rearward direction. In the course of the rearward motion of the impact piston 4, its control bores 4b are again closed, as they move past the edge 8a (or 8b) of the control sleeve 6. Exiting of the compressed air from the chamber 4c of the control sleeve 6 is blocked, while the impact piston 4 continues to move rearwardly building-up a dampening air cushion (which has a smaller dampening effect in the retraction working cycle as a result of the rearwardly displaced control edges 9a, 9b). Before the impact piston 4 reaches the rearward reversal point, its control bores 4b are again exposed as they move rearwardly over the edge 8b (or 9b) of the control recess, thus allowing the residual air pressure in the annular space between the piston 4 and the housing 1 to be discharged from the device through the bores 5a of the bearing ring 5. After the rearwardmost position the piston 4 again begins to move forward and the control edges 8a, 8b (or 9a, 9b) again sequentially cooperate with the control bores 4a as described above and the operation is repeated.

In order to define the respective end position of the control sleeve 6 which is rotatable in the bearing ring 5, and to prevent an unintentioned rotation of the control sleeve 6 relative to the bearing ring 5, the control sleeve 6 is secured in every end position by a forced, non-positive, spring-actuated or -biased and/or positive or frictional fit (without rubbing or slipping) securing against rotation. This rotational prevention or securing for example can be formed by correspondingly formed inclined surfaces and/or spring-biased abutment bodies.

I claim:

1. In a control device for two working cycles of forward movement and rearward movement respectively of a self-propelled pneumatic ram boring device with an impact piston which is axially displaceable in a control stroke between two abutments, respectively impacting one of the abutments in each working cycle, in an altogether tubular-shaped housing, whereby the axial forward movement and rearward movement of the ram boring device is controllable by rigid control edges of an adjustable control sleeve, the latter being supported on a bearing ring arranged in the rear part of a tubular-shaped housing, through which bearing ring a part of the control sleeve, which part is formed as a feed tube for compressed air, is led for connection to a compressed air hose, and which sleeve has a piston-shaped control head containing the control edges, the control head engaging in a cylindrical recess at a rear end of the impact piston cooperates with radial at least one control bore which are formed in the impact piston in the vicinity of the recess, the improvement wherein the control sleeve is mounted non-displaceably in the axial direction however rotatably in the bearing ring and is formed with at least four control edges, the control edges respectively being arranged in pairs with axial spacing between said control edges of each pair, forming two different types of pairs, said axial spacing of each said pair corresponding to the control stroke respectively of the impact piston, and said control edges of respectively each said two different types of pairs being offset in the peripheral direction as well as in the longitudinal direction such that respectively in one rotated position of said control sleeve during operation of the ram boring device in one of the two working cycles, only one of said two different types of pairs of the control edges is aligned with and cooperates with the at least one control bore and the other of the two different types of pairs is not aligned with and does not cooperate with at least one control bore, the latter being arranged only on a part of the periphery of the impact piston, and said impact piston being guided non-rotatable in the housing.

2. Control device according to claim 1, wherein said at least four control edges comprise only four control edges, said four control edges each respectively are formed extending over 180° of the periphery of said control sleeve and form only two of said pairs.

3. Control device according to claim 1, wherein said at least four control edges constitute eight control edges, each of said control edges extend over 90° of the periphery of the control sleeve, and identical of said control edges are formed diametrically oppositely one another on the control sleeve.

4. Control device according to claim 3, wherein said at least one control bore constitutes two control bores disposed 180 degrees opposite each other on the periphery of said impact piston.

5. Control device according to claim 1, wherein the piston-shaped control head is formed with a first recess starting from a rear end of the piston-shaped control head and a second recess extending from a front face edge of the control sleeve, said second recess is formed in part by a recess edge having an arc extending in the peripheral direction of the control head, one of the pair of control edges is a front pair of control edges constituting a front face edge of the control sleeve and an edge of said first recess, another of the pairs of control edges is a rear pair of control edges constituting said recess edge and a rear face edge of said control head.

6. Control device according to claim 1, further comprising means for securing said impact piston against rotation comprising, a ridge is formed on a cylindrical inner wall of said housing, said impact piston is formed with a longitudinal groove in which said ridge projects.

7. Control device according to claim 1, wherein said impact piston is formed with a longitudinal groove, at least two projections disposed spaced apart from one another are mounted on an inner wall of said housing, said projections engage in said longitudinal groove.

8. Control device according to claim 7, wherein said projections constitute screws which are screwed into the housing.

* * * * *